US006645371B2

(12) United States Patent
Vuillemot et al.

(10) Patent No.: US 6,645,371 B2
(45) Date of Patent: Nov. 11, 2003

(54) PROCESS FOR TREATING A HYDROCARBON FEED, COMPRISING A COUNTER-CURRENT FIXED BED HYDROTREATMENT STEP

(75) Inventors: Daniel Vuillemot, Saint Genis Laval (FR); Laurence Carpot, Vernaison (FR); Thierry Chapus, Lyons (FR); Philippe Rocher, Saint Bonnet de Mure (FR); Frédéric Morel, Francheville (FR)

(73) Assignee: Institut Francais Du Petrole, Rueil Malmaison Cedex (FR)

( * ) Notice: Subject to any disclaimer, the term of this patent is extended or adjusted under 35 U.S.C. 154(b) by 130 days.

(21) Appl. No.: 10/022,831

(22) Filed: Dec. 20, 2001

(65) Prior Publication Data

US 2002/0130063 A1 Sep. 19, 2002

(30) Foreign Application Priority Data

Dec. 20, 2000 (FR) ..... 00 16824

(51) Int. Cl.[7] ..... C10G 45/60

(52) U.S. Cl. ..... 208/216 R; 208/89; 208/85; 208/143; 208/210; 208/213; 208/216 PP; 208/217; 208/251 H; 208/254 H

(58) Field of Search ..... 208/216 R, 89, 208/85, 143, 210, 213, 216 PP, 217, 251 H, 254 H

(56) References Cited

U.S. PATENT DOCUMENTS

| | | | | |
|---|---|---|---|---|
| 3,147,210 A | | 9/1964 | Hass et al. | |
| 3,437,588 A | | 4/1969 | Kovach et al. | |
| 5,110,444 A | * | 5/1992 | Haun et al. | 208/89 |
| 5,368,722 A | * | 11/1994 | Bartholdy | 208/149 |
| 5,589,057 A | * | 12/1996 | Trimble et al. | 208/148 |
| 5,624,547 A | * | 4/1997 | Sudhakar et al. | 208/89 |
| 5,837,128 A | * | 11/1998 | Huff et al. | 208/112 |
| 6,299,758 B1 | * | 10/2001 | Okazaki et al. | 208/15 |

FOREIGN PATENT DOCUMENTS

WO 97/03150 WO 1/1997

* cited by examiner

*Primary Examiner*—Walter D. Griffin
*Assistant Examiner*—James Arnold, Jr.
(74) *Attorney, Agent, or Firm*—Millen, White, Zelano & Branigan, P.C.

(57) ABSTRACT

A process is described that can limit pressure drops during a catalytic hydrotreatment process carried out in a fixed bed reactor. The liquid feed and gaseous reactant are injected into the reactor either side of the bed and flow as a counter-current. Pressure drops are limited by homogeneously mixing solid catalytic and/or inert particles of different diameters in the bed.

24 Claims, No Drawings

PROCESS FOR TREATING A HYDROCARBON FEED, COMPRISING A COUNTER-CURRENT FIXED BED HYDROTREATMENT STEP

The present invention relates to hydrotreatment (HDT) of hydrocarbon fractions to produce hydrocarbon fractions with a low sulphur, nitrogen and aromatic compound content particularly for use in the field of fuel for internal combustion engines. Such hydrocarbon fractions include jet fuel, diesel fuel and kerosine. In this field, the invention is or particular application during processes for transforming a middle distillate, more particularly a gas oil cut with a view to producing dearomatised and desulphurised high cetane index fuel. The invention can also be applied to hydrotreating heavier products, alone or as a mixture with diluents, for example hydrocarbon fractions from atmospheric or vacuum distillation in the context of hydrodemetallisation (HDM), hydrodesulphurisation (HDS) or hydrodenitrogenation (HDN) reactions.

The present process can be carried out both to improve the characteristics of the finished product as regards the specifications required to achieve the quality of the products and the pollution standards (sulphur and aromatic compound content in particular) and to prepare feeds for refinery units for transforming or converting (visbreaking, cokefaction or catalytic cracking for a vacuum distillate, isomerisation or reforming for a naphtha, for example) using catalysts that are sensitive to impurities (for example sulphur for metal catalysts, nitrogen for acidic catalysts and metals in general).

In the context of desulphurising and dearomatising gas oil cuts, current legislation in the majority of industrialised countries requires that the fuel used in said engines contains a quantity of sulphur that is less than about 500 parts per million (ppm). In the vast majority of those states, there are currently no standards imposing a maximum aromatic compound and nitrogen content. However, a number of states, such as Sweden and California, envisage limiting the aromatics content to a value of less than 20% by volume, or even less than 10% by volume and some experts believe that this content could be limited to 5% by volume. In Sweden in particular, some classes of diesel fuel already have to satisfy very strict specifications. In that state, class II diesel fuel must not contain more than 50 ppm of sulphur and no more than 10% by volume of aromatic compounds, and class I fuel no more than 10 ppm of sulphur and 5% by volume of aromatic compounds. In Sweden, class III diesel fuel must currently contain less than 500 ppm of sulphur and less than 25% by volume of aromatic compounds. Similar limits are also in force for the sale of that type of fuel in California.

Meanwhile, motorists in a number of states are pressing for legislation to force oil suppliers to produce and sell a fuel with a cetane index with a minimum value. Current French legislation requires a minimum cetane index of 51, but in the near future this may be at least 53 (as is already the case for class I fuel in Sweden) and probably at least 55, most probably in the range 55 to 65.

Many specialists seriously predict the possibility of a future standard imposing a nitrogen content of less than about 200 ppm, for example, and perhaps less than 100 ppm. A low nitrogen content produces a more stable product and is generally desirable both from the vendor's and the manufacturer's viewpoint.

On the other hand, the heavy residual cuts from atmospheric distillation or vacuum distillation contain organometallic compounds in asphaltenes in which metals are found (nickel, vanadium, etc.). These poison the catalysts used when catalytically converting hydrocarbon cuts from vacuum distillation. While no standard has been imposed as regards the metals content in automobile fuels (apart from the lead content in gasoline), eliminating metals by hydrotreatment has proved to be vital.

In general, then, the development of reliable, effective processes for reducing the contents of both aromatic compounds, sulphur and nitrogen as well as metals is necessary. In its broadest sense, the process of the present invention concerns any process in which a fixed bed is used in a reactor during a catalytic process and in which a liquid feed and a gaseous reactant are injected into the reactor either side of the bed and flow in the bed as a counter-current. More particularly, the process is applicable to the hydrotreatment of petroleum cuts. The disadvantages and advantages of the different prior art processes in this area and the technical solutions proposed have recently been described by S. T. Sie (Fuel Processing Technology, 61, 149–171 (1999)).

The principal constraint linked to that type of device (fixed bed, counter-current of reactant fluids) is the possible existence of a flooding phenomenon, limiting the possible flow rate of each of the phases that may traverse the catalytic bed. Then, with the high gas pressures usually required when hydrotreating, there is a risk that the liquid phase will be entrained in the gas phase flowing as a counter-current. To limit risks of flooding, a counter-current flow can therefore only reasonably be envisaged if pressure drops in the catalytic bed are limited. A small catalyst size is known to entrain a large pressure drop. In order to increase the range of possible flow rates, an increase in the conventional supported catalyst particle dimensions generally adopted for fixed beds (0.5 to 10 mm) appears to be necessary, a priori. However, a larger grain size causes a reduction in catalytic activity in the reaction bed because of limited intra-particle diffusion of the feed in large particles.

The present invention aims to provide a process that can limit pressure drops linked to the use of a counter-current flow of fluids in a fixed bed reactor during a catalytic hydrotreatment process while retaining acceptable catalytic activity in the mixture of particles used.

In accordance with the invention, it has also been discovered that it is possible to limit hydrodynamic problems linked to pressure drops in the catalytic bed (flooding) and problems of the chemical reaction kinetics (catalyst size and activity) by dissociating the two.

In other words, one aim of the invention is to retain a reasonable catalytic activity in the bed while minimising pressure drops.

By way of non limiting example, the remainder of the description of the present invention uses hydrotreatment processes that can produce a product with improved characteristics as regards cetane index and thermal stability as an example, also aromatic compound content, olefin content, sulphur content and nitrogen content from conventional straight run gas oil cuts or products from another conversion process (cokefaction, visbreaking, residue hydroconversion, etc.).

Conventionally, the process layout for a hydrorefining unit is relatively simple. Firstly, the feed is mixed with a hydrogen-rich gas then heated to the reaction temperature (by heat exchanger or an oven). It then passes into a reactor in which hydrotreatment is carried out. After separation, the mixture obtained from the reactor produces:

- a gas rich in $H_2S$, nitrogen and impurities;
- light products resulting from decomposition of impurities, nitrogen and sulphur elimination and leading to the destruction of numerous molecules and to the production of lighter fractions;

a hydrorefined product with the same volatility as the feed, but with improved characteristics.

However, to obtain a residual sulphur content of the order of 5 ppm by weight and a diaromatics content of less than 2% by weight, the following constraining conditions are imposed:

the reaction temperature must be sufficient to activate the reaction. However, the increase in reaction temperature is limited by coke formation. It is generally in the range 340° C. to 370° C.;

the hydrogen pressure must be high (of the order of 60 bars at 350° C. for gas oil HDS and more than 80 bars for gas oil HDA at the same temperature) to displace the reactions in a favourable direction, minimise radical side reactions (leading, for example, to thermal cracking and/or to polymerisation and condensation of polynuclear aromatic compounds) and to the deposition of coke on the catalyst surface, which reduces service life. In general, the heavier the cut, the higher the hydrogen pressure.

To overcome these disadvantages, a hydrotreatment process has been proposed that is carried out in at least two successive steps, i.e., combining two reactors functioning under different operating conditions and with different catalysts in one device:

a first reactor for carrying out hydrodesulphurisation (HDS), said hydrotreatment resulting in the production of an effluent that is free of the major portion of its sulphur-containing components;

a second reactor, more specifically corresponding to a hydrodearomatisation zone (HDA) in which the catalyst generally comprises a noble metal or a compound of a noble metal from group VIII of the periodic table.

An intermediate stripping zone placed between the two reactors can evacuate the lightest compounds from the hydrodesulphurisation reaction ($H_2S$, $NH_3$, etc.).

One advantage of a two-step process (with at least partial desulphurisation of the feed during the first step) resides in the possibility of using a more specific catalyst in the second reactor dedicated to hydrogenation of aromatic rings (with the lowest reactivity) with no problem as regards deactivation thereof by $H_2S$. This technology has been described, for example, in U.S. Pat. No. 5,114,562.

Routinely, fixed bed processes are used to hydrotreat hydrocarbons. Usually, gas and liquid phases are in a co-current downflow mode along the reactor and through the catalytic bed. Examples of such technology are described in U.S. Pat. No. 5,292,428 and U.S. Pat. No. 5,741,414. While a priori, such a disposition appears to be easier to apply, a number of difficulties are encountered: the fluid flow must approach piston flow, i.e., the gas and liquid phases flow with identical linear velocities along the axis of the reactor. This requires large catalytic volumes because of the low space velocities and high flow rates. To limit pressure drops, the reactors necessarily have the largest possible diameters and the low linear velocities of the fluids in the reactors necessitates the use of highly effective distribution systems in these reactors. Further, the exothermic nature of the reaction renders temperature control along the reactor difficult and usually necessitates a temperature management strategy and injection of a cooling gas known as a quench gas directly into the reactor between the catalytic beds, usually followed by re-distribution of the reaction fluids. Finally, during operation of the reactor, it is known that a co-current flow of reactants causes deposition of sulphur or coke molecules, which obstructs the entrance to the catalyst pores in the upper portion of the fixed beds. Such phenomena are responsible for catalyst deactivation and large pressure drops.

To avoid such problems, counter-current motion in the fixed bed catalytic reactors between the fluid phases has been described in the prior art. Examples are described in U.S. Pat. No. 3,147,210 and U.S. Pat. No. 3,788,976. It is then possible to control the temperature along the reactor better and to improve the yield since the reaction takes place more homogeneously in the bed.

In the case of hydrogenating aromatic compounds in a hydrocarbon cut containing small quantities of sulphur (corresponding to the second HDA step of the process described above), the hydrogen sulphide formed is stripped as soon as it appears. In a counter-current flow, pure hydrogen is generally introduced close to the lower portion of the catalytic bed and is then brought into immediate contact with a liquid hydrocarbon fraction already substantially free of the major portion of the sulphur it contained at the reactor inlet. The hydrogenating activity of the aromatic rings is then a maximum with no risk of deactivation of the catalyst, containing a noble metal, by the hydrogen sulphide. Further, it is possible in this case to eliminate an intermediate product in the gas phase and to minimise the radical secondary reactions mentioned above.

More particularly, the present invention concerns a process for treating a hydrocarbon feed comprising sulphur-containing compounds, nitrogen-containing compounds and aromatic compounds, comprising at least one hydrotreatment step in which at least a liquid fraction of said hydrocarbon feed and hydrogen are caused to flow in a vessel as a counter-current through at least one fixed bed of solid particles, said fixed bed or beds of solid particles comprising a substantially homogeneous mixture of solid particles S1 with a mean diameter of about 0.5 to 5 mm and of solid particles S2 with a mean diameter that is higher than the mean diameter of solid particles S1. In accordance with the invention, at least a portion of at least one of said particles S1 or S2 is catalytic and comprises a mineral support. Preferably, the mean diameter of particles S1 is in the range 0.5 to 2 mm and more preferably in the range 1 to 2 mm. Solid particles S2 will advantageously have a mean diameter of at least 1.1 times that of solid particles S1. The mean diameter of particles S2 is generally in the range 1.1 to 10 times, more preferably in the range 1.5 to 5 times and still more preferably in the range 2 to 4 times the mean diameter of solid particles S1.

The mean diameter d as used in the present description means a diameter defined as:

$$d = \frac{6(V_{total})}{S_{ext}}$$

where $V_{total}$ is the total volume of particles composing a mean sample;

$S_{ext}$ is the total external surface area of the particles of said sample (P. Trambouze et al., Chemical reactors, Editions Technip, pages 334–337 (1988)).

In one implementation, at least a portion, and preferably all, of particles S1 are catalytic, and at least a portion, preferably all, of particles S2 are inert. The term "at least a portion of the (catalytic or inert) particles" means at least 20%, preferably at least 50%, more preferably at least 80% of particles.

In general, the ratio of the volume occupied in the bed by said catalytic solid particles over the volume occupied in the bed by said inert solid particles is in the range a bout 0.1 to 5, preferably in the range 0.3 to 2.

In general, the geometric shape of solid particles S1 is different from that of solid particles S2. The inert solid particles can be in the form of beads and/or rings and/or saddles. As an example, the inert solid particles can be solid, with a ring and/or saddle shape, and included in the group constituted by Raschig rings, Lessing rings, Pall rings and Hy-Pak rings, spiral wound rings, Berl saddles and Intalox saddles. The catalytic solid particles are advantageously in the form of extrudates and/or beads and/or pellets.

In a particular and advantageous implementation of the process of the invention, the catalytic solid particles are in the form of extrudates and the inert solid particles are in the form of beads.

In one implementation of the invention, at least a portion of said catalytic solid particles comprises a hydrotreatment catalyst comprising, on a mineral support, at least one metal or compound of a metal from group VIB, preferably selected from the group formed by molybdenum and tungsten, and at least one non noble metal or compound of a non noble metal from group VIII, preferably selected from the group formed by nickel, cobalt and iron.

In a further possible implementation, at least a portion of said catalytic solid particles is comprised by a hydrotreatment catalyst comprising, on a mineral support, at least one noble metal or a compound of a noble metal from group VIII, advantageously at least one metal or compound of a noble metal selected from the group formed by palladium and platinum, used alone or as a mixture.

In general, the support for said catalyst is selected from the group formed by alumina, silica, silica-aluminas, zeolites and mixtures of at least two of these mineral compounds.

When the hydrotreatment catalyst comprises at least one noble metal or a compound of a noble metal from group VIII, the support for said catalyst can also comprise at least one halogen, preferably selected from the group formed by chorine and fluorine.

In general, the solid particles of the present process comprise at least one compound selected from the group formed by alumina, silica, silica-aluminas, zeolites and mixtures of at least two of these mineral compounds.

The invention also concerns a process for treating a hydrocarbon feed comprising sulphur-containing compounds, nitrogen-containing compounds and aromatic compounds, comprising the following steps:

a) at least one first step in which said hydrocarbon feed and hydrogen are passed as a downflowing co-current into a hydrodesulphurisation zone containing at least one hydrodesulphurisation catalyst comprising, on a mineral support, at least one metal or compound of a metal from group VIB of the periodic table and at least one non noble metal or compound of a non noble metal from group VIII of said periodic table, said zone being maintained under at least partial hydrodesulphurisation conditions including a temperature of about 150° C. to about 450° C. and a pressure of about 1 MPa to about 20 MPa;

b) at least one second step in which the partially desulphurised feed from hydrodesulphurisation step a) is sent to a stripping zone in which it is purified by counter-current stripping using at least one hydrogen-containing gas at a temperature of about 100° C. to about 400° C. under conditions for forming a gaseous stripping effluent containing hydrogen and hydrogen sulphide and a liquid hydrocarbon feed that is depleted in sulphur-containing compounds;

c) at least one third step in which the liquid hydrocarbon feed that is depleted in sulphur-containing compounds from stripping step b) is sent to a catalytichydrotreatment zone in which said liquid hydrocarbon feed and hydrogen are caused to flow as a counter-current using a process employing a fixed bed of solid particles comprising a substantially homogeneous mixture of catalytic solid particles and inert solid particles in all of the variations, preferences and different embodiments described above, said zone being maintained under hydrotreatment conditions to obtain a liquid effluent containing fewer sulphur-containing compounds, nitrogen-containing compounds and aromatic compounds than the liquid hydrocarbon feed from step b).

Clearly, any follow-up device that is known to the skilled person can be included in the context of the present invention, for example supplemental stripping and/or recycling of hydrogen-containing gas and hydrogen sulphide from any one of the three steps above.

As an example, the gaseous effluent formed in the stripping step containing gaseous hydrocarbons under the conditions of said stripping zone, hydrogen and hydrogen sulphide can advantageously be cooled to a temperature sufficient to form a liquid hydrocarbon fraction that is sent to a stripping zone and a gas fraction that is depleted in hydrocarbons, which is sent to a zone for eliminating the hydrogen sulphide it contains and from which purified hydrogen is recovered.

In general, the catalyst for step a) comprises at least one metal or compound of a metal selected from the group formed by molybdenum and tungsten and at least one metal or compound of a metal selected from the group formed by nickel, cobalt and iron.

More particularly, the catalyst for step a) advantageously comprises at least one element selected from the group formed by silicon, phosphorus and boron or one or more compounds of that element or those elements.

In general, the supports for the catalysts used in step a) and in step c) are selected independently of each other from the group formed by alumina, silica, silica-aluminas, zeolites and mixtures of at least two of these mineral compounds.

The scope of the invention encompasses charging said solid particles into said vessel using any technique that is known to the skilled person, employing a means for producing a dense, homogeneous mixture of solid particles in the vessel. By way of example, any of the devices described in the Applicant's French patent FR-A-2 721 900, the Applicant's European patents EP-B1-0 482 991 or EP-B1-0 470 142 or one of the devices disclosed in British patent GB-A-2 168 330, U.S. Pat. No. 4,443,707 or EP-B1-0 769 462 can be used.

In a preferred implementation of the invention, the operating conditions for steps a) and c) are selected as a function of the characteristics of the feed, which can be a straight run gas oil cut, a gas oil cut from catalytic cracking or a gas oil fromcokefaction or visbreaking of residues or a mixture of two or more such cuts. They are normally selected so as to obtain a product at the outlet from step a) that contains less than 100 ppm of sulphur and less than 200 ppm of nitrogen, preferably less than 100 ppm of nitrogen and usually less than 50 ppm of nitrogen, and the conditions of step c) are selected to obtain a product at the outlet from said step c) containing less than 20% by volume of aromatic compounds. These conditions can be made more severe to produce, after the second step, a fuel containing less than 10% by volume of aromatic compounds or even less than 5% by volume of aromatic compounds, less than 50 ppm, or even less than 10 ppm of sulphur, less than 50 ppm, or even less than 20 ppm of nitrogen or even less than 10 ppm, and with a cetane index of at least 50 and even at least 55, usually in the range 55 to 60.

To obtain such results, the conditions for step a) include a temperature of about 260° C. to about 450° C., a total pressure of about 2 MPa to about 20 MPa and an overall hourly space velocity of liquid feed of about 0.1 to about 4; for step b), the conditions are: a temperature of about 100° C. to about 400° C., and a total pressure of about 3 MPa to about 15 MPa.

The catalyst used in step a) contains, on a mineral support, at least one metal or compound of a metal from group VIB of the periodic table in a quantity, expressed as the weight of metal with respect to the weight of finished catalyst, which is normally about 0.5% to 40%, at least one non noble metal or compound of a non noble metal in a quantity, expressed as the weight of metal with respect to the weight of finished catalyst, that is normally about 0.1% to 30%. Frequently, the catalyst used will also contain at least one element selected from the group formed by silicon, phosphorus and boron or compounds of that element or elements. The catalyst will, for example, contain phosphorus or at least one phosphorus compound in a quantity, expressed as the weight of phosphorous pentoxide with respect to the weight of the support, of about 0.001% to 20%. In a particular implementation of the invention, the catalyst will contain boron or at least one boron compound, preferably in a quantity of about 0.001% to 10%, expressed as the weight of boron trioxide with respect to the weight of the support. In a further implementation, the catalyst will contain silicon or at least one silicon compound, preferably in a quantity, expressed as the weight of silica with respect to the weight of the support, of about 0.001% to 10%. The quantity of metal or compound of a metal from group VIB, expressed as the weight of metal with respect to the weight of final catalyst, is preferably about 2% to 30%, usually about 5% to 25%, and that of the metal or compound of a metal from group VIII is preferably about 0.5% to 15%, usually about 1% to 10%.

When a relatively low pressure range is to be retained, along with excellent results, it is possible to carry out a first step al) under conditions that can reduce the sulphur content of the product to a value of about 500 to 800 ppm then to send the product to a subsequent step a2) in which the conditions are selected to drop the sulphur content to a value below about 100 ppm, preferably below about 50 ppm, and the product from step a2) is then sent to step b). In this implementation, the conditions of step a2) are milder than when, for a given feed, a single step a) is used, since the product sent to this step a2) already has a reduced sulphur content. In this implementation, the catalyst of step a1) can be a conventional prior art catalyst such as that described in the text of the Applicant's patent applications FR-A-2 197 966 and FR-A-2 538 813 and that of step a2) is that described above for step a). The scope of the invention encompasses using the same catalyst in steps a1) and a2).

In these steps a), a1), a2), the mineral support for the catalyst is preferably selected from the group formed by alumina, silica, silica-aluminas, zeolites and mixtures of at least two of these mineral compounds. Alumina is routinely used.

In a preferred implementation of the invention, the catalyst of these steps a), a1), a2) comprises at least one metal or compound of a metal selected from the group formed by molybdenum and tungsten and at least one metal or compound of a metal selected from the group formed by nickel, cobalt and iron. Usually, this catalyst contains molybdenum or a molybdenum compound and at least one metal or compound of a metal selected from the group formed by nickel and cobalt.

In a particular and preferred implementation of the invention, the catalyst for these steps a), a1), a2) comprises boron or at least one boron compound. Other implementations are also frequently employed, in which case, the catalyst comprises, for example, silicon or a silicon compound, or a combination of silicon and boron or compounds of each of these elements, optionally combined with phosphorus or with a phosphorous compound. The proportions of boron, silicon and phosphorus by weight with respect to the support will be the same as those stated above. Non-limiting examples of specific combinations containing these elements or compounds of these elements that can be cited are:Ni—Mo—P, Ni—Mo—P—B, Ni—Mo—Si, Ni—Mo—Si—B, Ni—Mo—P—Si, Ni—Mo—Si—B—P, Co—Mo—P, Co—Mo—P—B, Co—Mo—Si, Co—Mo—Si—B, Co—Mo—P—Si, Co—Mo—Si—B—P, Ni—W—P, Ni—W—P—B, Ni—W—Si, Ni—W—Si—B, Ni—W—P—Si, Ni—W—Si—B—P, Co—W—P, Co—W—P—B, Co—W—Si, Co—W—Si—B, Co—W—P—Si, Co—W—Si—B—P, Ni—Co—Mo—P, Ni—Co—Mo—P—B, Ni—Co—Mo—Si, Ni—Co—Mo—Si—B, Ni—Co—Mo—Si—P, Ni—Co—Mo—P—B—Si.

The catalyst used in step c) contains, on a mineral support, at least one noble metal or compound of a noble metal from group VIII of the periodic table in a quantity, expressed as the weight of metal with respect to the weight of finished catalyst, of about 0.01% to 20%, and preferably at least one halogen. The mineral support of the catalyst used in step c) is selected independently of the support used for the catalyst of step a). Usually, the catalyst of step c) will comprise at least one metal or compound of a noble metal selected from the group formed by palladium and platinum.

The mineral support for the catalyst used in step c) is normally selected from the group formed by alumina, silica, silica-aluminas, zeolites and mixtures of at least two of these mineral compounds. This support will preferably comprise at least one halogen selected from the group formed by chlorine, fluorine, iodine and bromine, preferably selected from the group formed by chlorine and fluorine. In an advantageous implementation, this support will comprise chlorine and fluorine. The quantity of halogen will usually be about 0.5% to about 15% by weight with respect to the weight of support. The most frequently used support is alumina. The halogen is normally introduced into the support from the corresponding acid halides and the platinum or palladium is introduced from aqueous solutions of their salts, or from compounds such as hexachloroplatinic acid in the case of platinum.

The quantity of metal in this catalyst for step c) is preferably about 0.01% to 10%, usually about 0.01% to 5%, and usually about 0.03% to 3%, expressed as the weight of metal with respect to the weight of finished catalyst.

The invention will be better understood from the following examples, which illustrate the invention without limiting its scope:

EXAMPLE 1

Comparative

A gas oil cut from a mixture of a straight run gas oil (GOSR) and a catalytic cracking gas oil (LCO) was used.

The mixture was desulphurised in a conventional desulphurisation unit then stripped in a first step.

More precisely, a 1 liter (I) reactor was provided with a catalyst containing nickel and molybdenum sold by Procatalyse under reference number HR448. After activating the catalyst by sulphurisation, the unit was kept at a pressure of 5 MPa and at a temperature of 340° C. The gas oil feed was injected at an HSV of 1.5 $h^{-1}$. A quantity of hydrogen corresponding to a $H_2$/feed ratio of 400 I/I was injected, the feed/hydrogen mixture traversing the catalytic bed as an upflow. Under these conditions, the sulphur content was reduced to 50 ppm.

The most volatile components of the gas oil cut obtained were then eliminated by counter-current stripping with hydrogen at atmospheric pressure (about 0.1 MPa) and at a temperature of 80° C.

The characteristics of the gas oil cut before and after this first desulphurisation step and stripping are shown in columns 1 and 2 respectively of Table 1.

In a second step, the gas oil cut obtained was eliminated then used as a feed for a unit containing 1 liter of catalyst containing 0.6% by weight of platinum on analumina support sold by Procatalyse under reference number LD402.

This second step was carried out with a co-current upflow of fluids. The hydrogen was injected as a co-current with the feed and was not recycled.

The catalyst was in the form of extrudates with a diameter of 1.2 mm and a length of 4 mm. The mean diameter, calculated using the formula given above, was 1.5 mm.

The operating conditions were as follows:

HSV (hourly space velocity per volume of catalyst)=2 $h^{-1}$;

Total pressure=5 MPa;

$H_2$ flow rate=400 liters of $H_2$/liter of feed;

Temperature=300° C.

A highly dearomatised product (polyaromatics content of less than 1%) was obtained. These detailed characteristics are shown in Table 1, column 3. Gas chromatographic analysis of the boiling point range for the different hydrocarbon fractions obtained, carried out in accordance with ASTM D2887 (simulated distillation, Sim Dist), showed a significant reduction in the temperature of the different points on the distillation curve when the treatment was carried out in two steps.

EXAMPLE 2

Comparative

The feed was the desulphurised and stripped gas oil from the first step described in the preceding example, with the characteristics shown in column 2 of Table 1. The second step was carried out in a pilot unit containing 1 liter of catalyst sold byProcatalyse under reference number LD402 and functioning in fluid counter-current mode at a pressure of 5 MPa and at a temperature of 300° C. The unit's feed flowed as a downflow while the hydrogen flowed as an upflow in the reactor. Flooding was observed and the major portion of the injected feed was entrained by the gas stream and did not traverse the reactor.

EXAMPLE 3

In Accordance with the Invention

The desulphurised and stripped gas oil from the first step described in Example 1 was used. As was the case for Example 2, the second step was carried out in a pilot unit functioning in fluid counter-current mode. The unit's feed flowed as a downflow and the hydrogen flowed in the reactor as an upflow.

In contrast to the preceding case, catalyst LD402 was not charged as is into the unit, but it was diluted with 5 mm diameter (mean diameter) alumina beads. The mixture was constituted by half (by volume) of the catalyst LD402 and half (by volume)alumina beads. 1 liter of substantially homogeneous mixture of catalyst and alumina beads was charged into the unit.

Filling the reactor as described above had the dual advantage of producing a catalyst with a small grain size (the mean diameter of the catalytic particles was about 1.5 mm) with excellent catalytic activity, and secondly, substantially reduced the pressure drops due to the presence of large diameter alumina beads, thus preventing any problems are regards flooding in the reactor. A small quantity of liquid product was entrained to the head of the reactor (about 10%); it was re-mixed with the principal liquid product recovered from the bottom of the reactor to constitute the total liquid effluent.

The operating conditions were as follows:

HSV (HSV with respect to the catalyst volume)=6 $h^{-1}$;

total pressure=50 bars;

$H_2$ flow rate=400 I. $H_2$/I of feed;

temperature=300° C.

A highly dearomatised product was obtained (polyaromatics content less than 1%) with a high cetane index. These characteristics are shown in detail in column 4 of Table 1, compared with the effluents from Example 1.

It can be seen that the qualities of the gas oil obtained are similar to those of the preceding example despite an HSV that was three times higher.

TABLE 1

| | 1 Feed GOSR + LCO | 2 Effluent 1st step | 3 Effluent 2nd step Co-current HSV = 2 $h^{-1}$ | 4 Effluent 2nd step Counter-current HSV = 6 $h^{-1}$ |
|---|---|---|---|---|
| Density 15/4 | 0.871 | 0.845 | 0.835 | 0.834 |
| Sulphur (ppm by wt) | 13800 | 50 | <5 | <5 |
| Nitrogen (ppm by wt) | 288 | 0.9 | <0.5 | <0.5 |
| Sim Dist 5 wt % (° C.) | 207 | 192 | 186 | 185 |
| Sim Dist 50 wt % (° C.) | 295 | 284 | 280 | 278 |
| Sim Dist 95 wt % (° C.) | 381 | 376 | 375 | 375 |
| Mono ars (wt %) | 21.0 | 30.4 | 12.5 | 11.5 |
| Polyars (wt %) | 21.8 | 2.7 | 0.8 | 0.8 |
| Total aromatics (wt %) | 42.8 | 33.1 | 13.3 | 12.3 |
| Cetane index | | 51 | 54 | 55 |

The scope of the invention encompasses desulphurisation, denitrogenation and dearomatisation of gas oil cuts, kerosine cuts, vacuum distillates from a refining unit, or white oils.

The preceding examples can be repeated with similar success by substituting the generically or specifically described reactants and/or operating conditions of this invention for those used in the preceding examples. Also, the preceding specific embodiments are to be construed as merely illustrative, and not limitative of the remainder of the disclosure in any way whatsoever.

The entire disclosure of all applications, patents and publications, cited above and below, and of corresponding French application 00/16.824, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for treating a hydrocarbon feed comprising sulphur-containing compounds, nitrogen-containing compounds and aromatic compounds, comprising at least one hydrotreatment step in which at least a liquid fraction of said hydrocarbon feed and hydrogen are caused to flow countercurrently in a vessel through at least one fixed bed of solid particles, the improvement wherein said fixed bed or beds of solid particles comprises a substantially homogeneous mixture of solid particles S1 with a mean diameter of about 0.5 to 5 mm and of solid particles S2 with a mean diameter that is higher than the mean diameter of solid particles S1, and in that at least a portion of at least one of said particles S1 or S2 is catalytic and comprises a mineral support.

2. A process according to claim 1, in which at least a portion of solid particles S1 is catalytic and comprises a mineral support and at least a portion of solid particles S2 is inert and contains at least one mineral compound.

3. A process according to claim 1, in which the ratio of the volume occupied in the bed by said catalytic solid particles over the volume occupied in the bed by said inert solid particles is about 0.1 to 5.

4. A process according to claim 1, in which solid particles S1 have a geometric shape that is different from those of solid particles S2.

5. A process according to claim 1, in which the catalytic solid particles are in the form of at least one of extrudates, beads, and pellets.

6. A process according to claim 2, in which the inert solid particles are in the form of at least one of beads, rings, and saddles.

7. A process according to claim 2, in which the catalytic solid particles are in the form of extrudates and the inert solid particles are in the form of beads.

8. A process according to claim 1, in which said catalytic solid particles comprise at least a portion of a hydrotreatment catalyst comprising, on a mineral support, at least one metal or compound of a metal from group VIB selected from the group consisting of molybdenum and tungsten, and at least one non noble metal or compound of a non noble metal from group VIII selected from the group consisting of nickel, cobalt and iron.

9. A process according to claim 1, in which at least a portion of said catalytic solid particles comprises a hydrotreatment catalyst comprising, on a mineral support, at least one noble metal or a compound of a noble metal from group VIII.

10. A process according to claim 1, in which the support for said hydrotreatment catalyst is selected from the group consisting of alumina, silica, silica-aluminas, zeolites and mixtures thereof.

11. A process according to claim 1, in which the support for the hydrotreatment catalyst comprises at least one halogen.

12. A process according to claim 1, in which the hydrotreatment catalyst comprises at least one metal or compound of a noble metal selected from the group consisting of palladium and platinum and mixtures thereof.

13. A process according to claim 2, in which the inert solid particles comprise at least one mineral compound selected from the group consisting of alumina, silica, silica-aluminas, zeolites and mixtures thereof.

14. A process for treating a hydrocarbon feed comprising sulphur-containing compounds, nitrogen-containing compounds and aromatic compounds, comprising the following steps:

a) at least one first step in which said hydrocarbon feed and hydrogen are passed as a downflowing co-current into a hydrodesulphurisation zone containing at least one hydrodesulphurisation catalyst comprising, on a mineral support, at least one metal or compound of a metal from group VIB of the periodic table and at least one non noble metal or compound of a non noble metal from group VIII of said periodic table, said zone being maintained under at least partial hydrodesulphurisation conditions including a temperature of about 150° C. to about 450° C. and a pressure of about 1 MPa to about 20 MPa;

b) at least one second step in which the partially desulphurised feed from hydrodesulphurisation step a) is sent to a stripping zone in which it is purified by counter-current stripping using at least one hydrogen-containing gas at a temperature of about 100° C. to about 400° C. under conditions for forming a gaseous stripping effluent containing hydrogen and hydrogen sulphide and a liquid hydrocarbon feed that is depleted in sulphur-containing compounds;

c) at least one third step in which the liquid hydrocarbon feed that is depleted in sulphur-containing compounds from stripping step b) is sent to a catalytic hydrotreatment zone in which said liquid hydrocarbon feed and hydrogen are caused to flow countercurrently in accordance with the process according to claim 1, said zone being maintained under hydrotreatment conditions to obtain a liquid effluent containing fewer sulphur-containing compounds, nitrogen-containing compounds and aromatic compounds than the liquid hydrocarbon feed from step b).

15. A process according to claim 14, in which the catalyst for step a) comprises at least one metal or compound of a metal selected from the group formed by molybdenum and tungsten and at least one metal or compound of a metal selected from the group formed by nickel, cobalt and iron.

16. A process according to claim 14, in which the catalyst for step a) further comprises at least one element selected from the group consisting of silicon, phosphorus and boron or one or more compounds of said at least one element.

17. A process according to claim 14, wherein step c) is conducted in the presence of a catalyst comprising a mineral support and in which the mineral supports for the catalysts used in step a) and in step c) are selected independently of each other from the group consisting of alumina, silica, silica-aluminas, zeolites and mixtures thereof.

18. A process according to claim 1, comprising charging said solid particles into said vessel so as to produce a dense, homogeneous mixture of solid particles in the vessel.

19. A process according to claim 1, comprising conducting at least one of desulphurisation, denitrogenation and dearomatisation of gas oil cuts.

20. A process according to claim 1, comprising conducting at least one of desulphurisation, denitrogenation and dearomatisation of kerosine cuts.

21. A process according to claim 1, comprising conducting at least one of desulphurisation, denitrogenation and dearomatisation of a vacuum distillate from a refining unit.

22. A process according to claim 1, comprising conducting at least one of desulphurisation, denitrogenation and dearomatisation of white oils.

23. A process according to claim 3, wherein said ratio is 0.3 to 2.

24. A process according to claim 11, wherein said halogen comprises chlorine, fluorine or mixtures thereof.

* * * * *